US005083133A

United States Patent [19]

Takayama

[11] Patent Number: 5,083,133

[45] Date of Patent: Jan. 21, 1992

[54] WINDOW GLASS ANTENNA FOR VEHICLE

[75] Inventor: Masami Takayama, Saitama, Japan

[73] Assignee: Pioneer Electronic Corporation, Tokyo, Japan

[21] Appl. No.: 675,056

[22] Filed: Mar. 26, 1991

Related U.S. Application Data

[63] Continuation of Ser. No. 363,822, Jun. 9, 1989, abandoned.

[30] Foreign Application Priority Data

Mar. 24, 1988 [JP] Japan ..... 63-110011[U]
Nov. 9, 1988 [JP] Japan ..... 63-145355[U]

[51] Int. Cl.[5] ..... H01Q 1/32; H01Q 1/02
[52] U.S. Cl. ..... 343/704; 343/713
[58] Field of Search ..... 343/704, 710, 711, 712, 343/713

[56] References Cited

U.S. PATENT DOCUMENTS

| | | | |
|---|---|---|---|
| 3,728,732 | 4/1973 | Igarashi | 343/713 |
| 3,971,029 | 7/1976 | Torii et al. | 343/704 |
| 4,439,771 | 3/1984 | Kume et al. | 343/713 |
| 4,823,140 | 4/1989 | Shibata et al. | 343/713 |

FOREIGN PATENT DOCUMENTS

| | | | |
|---|---|---|---|
| 0065263 | 11/1982 | European Pat. Off. . | |
| 2360672 | 5/1975 | Fed. Rep. of Germany . | |
| 2440439 | 3/1976 | Fed. Rep. of Germany . | |
| 2809454 | 9/1979 | Fed. Rep. of Germany . | |
| 3406580 | 8/1985 | Fed. Rep. of Germany . | |
| 3618452 | 12/1987 | Fed. Rep. of Germany . | |
| 3721934 | 1/1988 | Fed. Rep. of Germany . | |
| 3630519 | 3/1988 | Fed. Rep. of Germany . | |
| 0013404 | 4/1984 | Japan | 343/713 |
| 2193846 | 2/1988 | United Kingdom . | |
| WO87/05446 | 9/1986 | World Int. Prop. O. . | |

*Primary Examiner*—Michael C. Wimer
*Assistant Examiner*—Hoanganh Le
*Attorney, Agent, or Firm*—Sughrue, Mion, Zinn Macpeak & Seas

[57] ABSTRACT

A windshield antenna for a vehicle is mounted on a central portion of a window glass of the vehicle. The heating wires serve both as a window defogger element and as an antenna for receiving amplitude-modulated (AM) waves. A pair of first and second antenna elements are disposed on right and left sides of the heating wire, each of the first and second antenna elements serving as an antenna for receiving frequency-modulated (FM) waves. These antenna elements can be the same size, yielding improved diversity reception characteristics.

10 Claims, 1 Drawing Sheet

WINDOW GLASS ANTENNA FOR VEHICLE

This is a continuation of application Ser. No. 07/363,822 filed June 9, 1989 now abandoned.

BACKGROUND OF THE INVENTION

This invention relates generally to a windshield antenna, for a vehicle and, more particularly, to an antenna which is mounted on a rear windshield of a vehicle on which a rear window defogger (defroster) comprising heating wires is mounted.

FIG. 1 shows one conventional antenna of the type described. More specifically, a plurality of heating wires 2 which together constitute a window defogger are mounted on a rear windshield 1 of a vehicle in parallel, closely spaced relation to one another, and extend longitudinally of the rear windshield 1. A pair of first and second antenna elements 3 and 4 are mounted on the rear windshield 1 parallel to and above and below the defogger heating wires 2. Electric power is supplied from a battery 6 of the vehicle to the defogger heating wires 2 via a power supply wire 8*a*, which is wound on a ferrite core 7. A grounding wire 8*b* also is wound on the ferrite core 7 so that the power supply wire 8*a*, and hence the defogger heating wires 2 are grounded to the body of the vehicle. Thus, this arrangement is set so that the inductance produced by the wires wound around the ferrite core 7 has a high impedance at a receiving frequency, so that the defogger heating wires 2 are isolated from the earth of the vehicle body, thereby reducing the influence of the defogger wires 2 in the directivity of the antenna elements. Moreover, the power supply wire 8*a* and the grounding wire 8*b* are connected together electrically through the ferrite core 7, and this prevents noise from developing in the defogger heating wires 2. Reference numeral 5 denotes rear pillars on the vehicle.

The first antenna element 3 serves as an antenna for receiving both FM (frequency-modulated) waves and AM (amplitude-modulated) waves, while the second antenna element 4 serves as a sub-antenna for FM waves. The outputs of the two antenna elements 3 and 4 are connected respectively to amplifiers 9 and 10 contained in the rear pillar 5. Particularly when receiving FM broadcasting, one of the first and second antenna elements 3 and 4 having a better signal reception condition is selectively used; such is known as "diversity reception" in the trade.

In the above conventional windshield antenna, since the upper side and lower side of the rear window glass 1 are different in length from each other, it is difficult to design the two antenna elements 3 and 4 to have the same reception characteristics. The two antenna elements 3 and 4 themselves differ in gain because of the differences in size and shape. Therefore, when the diversity reception is performed by the antenna elements 3 and 4, a satisfactory diversity effect cannot be obtained, since the two antenna elements 3 and 4 have different gains in the first place.

Further, it is difficult to design the FM antenna elements 3 and 4, disposed respectively on the upper and lower sides of the defogger heating wires 2, to have the same reception characteristics because of the difference in their spatial positions from the surface of the ground, the difference between the upper and lower their antenna patterns 3 and 4 in antenna pattern such as the shape and size in view of the receiving band, and so on.

Therefore, a difference in gain occurs between the two antenna elements. As a result, when diversity reception is performed by the antenna elements 3 and 4, the rate of selecting one of the two antennas which has a higher gain is high because of the presence of such gain difference. This prevents a good diversity reception from being performed.

Still, further, since the first antenna element 3 is designed to receive both FM and AM waves, it is quite difficult to obtain good reception characteristics with respect to both. Further, the amplifiers 9 and 10 have to be mounted within one of the rear pillars 5 because of the position of mounting of the antenna elements 3 and 4. This considerably limits the size and shape of these amplifiers.

SUMMARY OF THE INVENTION

In view of the foregoing, it is an object of this invention to provide a windshield antenna for a vehicle which has good diversity reception, has good reception characteristics with respect to both AM and FM waves, and does not limit the size and shape of the amplifiers which are connected to the antenna elements.

According to the present invention, there is provided a windshield antenna for a vehicle having a rear windshield, the antenna including:

(a) a heating wire mounted on a central portion of the rear window glass, the heating wire serving as a window defogger element, and also as an antenna for receiving amplitude-modulated (AM) waves; and (b) a pair of first and second antenna elements disposed on right and left sides of the heating wire, each of the first and second antenna elements serving as an antenna for receiving frequency-modulated (FM) waves.

The first and second FM antenna elements are disposed on the right and left sides of the heating wire, and therefore the two antenna elements can be of the same configuration because the rear window glass is symmetrical with respect to its generally vertical central axis. Therefore, there is no difference in gain between the two antenna elements, which is suitable for a diversity reception. Further, the spacing between the first and second antenna elements can be greater than that between the upper and lower antenna elements 3 and 4 of the conventional antenna (FIG. 1), and therefore good space diversity reception characteristics can be obtained. Still further, since the AM antenna elements are mounted on the central portion of the rear glass of the vehicle in a multi-line fashion, AM waves can be received by the antenna having a wide receiving area. Yet another advantage is that, since the FM antenna elements are disposed on the right and left sides of the heating wire, amplifiers to be connected respectively to these antenna elements can be mounted below a rear tray of the vehicle. Therefore, the shape and size of these amplifiers are much less limited.

DETAILED DESCRIPTION OF THE PREFERRED EMBODIMENT

Figure 2:
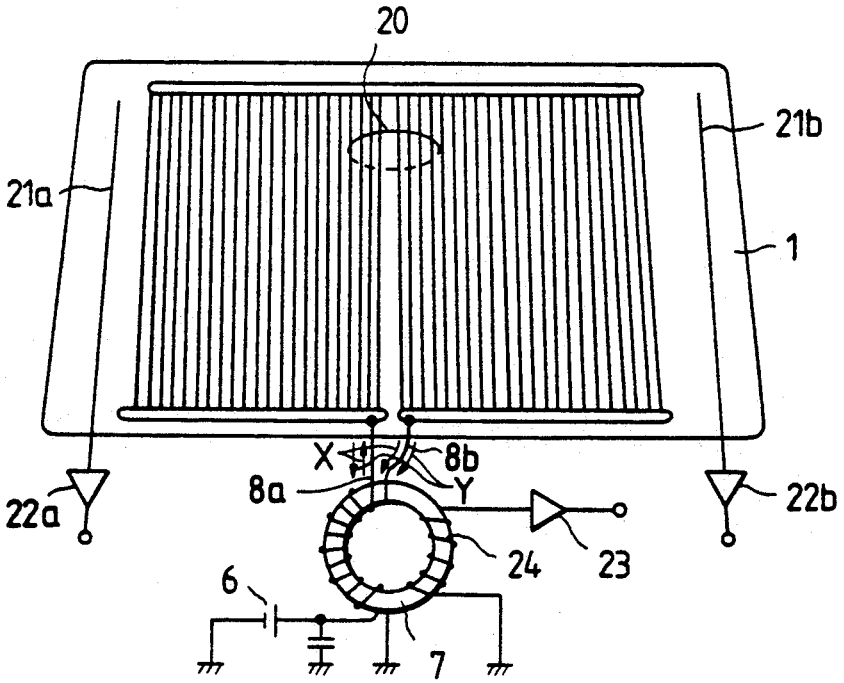
FIG. 2 is a schematic plan view of a rear window glass of a vehicle incorporating a windshield antenna provided in accordance with the present invention.

This invention will now be described with reference to FIG. 2, in which a window glass antenna comprises a plurality of linear heating wires 20 mounted on a rear windshield 11 of a vehicle (e.g., an automobile) in parallel, closely spaced relation to one another and extending along the width direction of the rear windshield 11 (i.e., upwardly and downwardly with respect to the rear windshield 1), the heating wires 20 disposed at the central portion of the rear windshield 1 constituting a window defogger (defroster). A pair of first and second antenna elements 21*a* and 21*b* for receiving FM waves are mounted on the rear window glass 1 parallel to the defogger heating wires 20 (i.e, generally vertically), and are disposed to the left and right of the defogger heating wires 20, respectively. The first and second linear antenna elements 21*a* and 21*b* are arranged symmetrically with respect to the defogger heating wires 20. The first and second antenna elements 21*a* and 21*b* are connected respectively at their lower ends to amplifiers 22*a* and 22*b* contained in a rear trunk of the vehicle disposed immediately below these antenna elements. The amplifiers 22*a* and 22*b* amplify the FM signal received by the antenna elements 21*a* and 21*b* and feed it to an FM receiver (not shown).

Electric power is supplied from a battery 6 of the vehicle to the defogger heating wires 20 via a power supply wire 8*a* which is wound on a ferrite core 7. A grounding wire 8*b* also is wound on a ferrite core 7, so that the power supply wire and hence the defogger heating wires 20, are grounded to a body of the vehicle. Thus, the power supply wire 8*a* and the grounding wire 8*b* are connected together electrically through the ferrite core 7, to prevent noise from developing in the defogger heating wires 20. Also, a signal feed wire 24 is wound on the ferrite core 7, one end of the signal feed wire 24 being grounded while the other end is connected to an amplifier 23. With the above construction, an electric current to be supplied to the defogger heating wires 20 is supplied to the primary side of the ferrite core 7 in the opposite phase as indicated by arrows X in the drawings, thereby preventing the magnetic saturation of the ferrite core 7 which would be caused by the flow of a direct current, and the signal of an AM band present in the defogger heating wires 20 flows in the same phase in a direction indicated by arrows Y and can be taken out from the secondary side of the ferrite core 7.

The AM receiving signal, received by the defogger heating wires 20 serving as the AM antenna having a wide receiving area, is taken out through the ferrite core 7 as described above, and then is amplified by the amplifier 23 and is fed to an AM receiver (not shown).

The FM receiver, to which the FM signal is fed from the first and second antenna elements 21*a* and 21*b* via the respective amplifiers 22*a* and 22*b*, selects the one of the two antenna elements 21*a* and 21*b* which has a better reception condition to conduct diversity reception.

Figure 3:
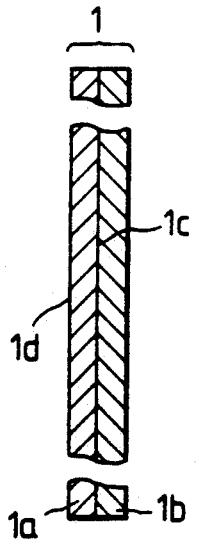
FIG. 3 is a cross-sectional view of a partly-modified version of the vehicle glass antenna of FIG. 2.

In the above embodiment, the defogger heating wires 20 are used as the AM antenna element. However, in the case where the rear glass comprised a laminated glass as shown in FIG. 3, the defogger heating wires 20 may be mounted on one of the surface 1*c* of contact between two mated glass panes 1*a* and 1*b* of the laminated glass and the surface 1*d* of the glass pane 1*a* facing the interior of the vehicle, and in this case separate AM antenna elements independent of the defogger heating wires 20 are mounted on the other of the surface 1*c* and the surface 1*d*. Such AM antenna elements are superimposed on the defogger heating wires 20 mounted on the different surface, and occupy generally the entire central area of the rear glass, and are arranged in a multiline fashion.

Because the right and left sides of the rear windshield 1 are the same length, the first and second antenna elements 21*a* and 21*b* may be designed with relative ease to have the same reception characteristics, and the two antenna elements 21*a* and 21*b* can be designed to have the same gain. Therefore good diversity reception can be Further, the defogger heating wires 20 also serve as the AM antenna elements, or alternatively the AM antenna elements are superimposed on the defogger heating wires 20 to constitute the antenna having a wide receiving area. Therefore, good reception characteristics with respect to the AM wave can be obtained.

Still, further, since the first and second antenna elements 21*a* and 21*b* connected respectively to the amplifiers 22*a* and 22*b* are positioned on the left and right sides of the defogger heating wires 20, the two amplifiers 22*a* and 22*b* do not need to be contained in a rear pillar of the vehicle, as was the case with a conventional system. Therefore, the shape and size of the amplifiers 22*a* and 22*b* need not be so limited. Furthermore, the distance between each of the first and second antenna elements 21*a* and 21*b* and the input terminal of a respective one of the amplifiers can be reduced, and therefore an influence of the impedance of signal wires connecting them can be reduced.

Figure 1:
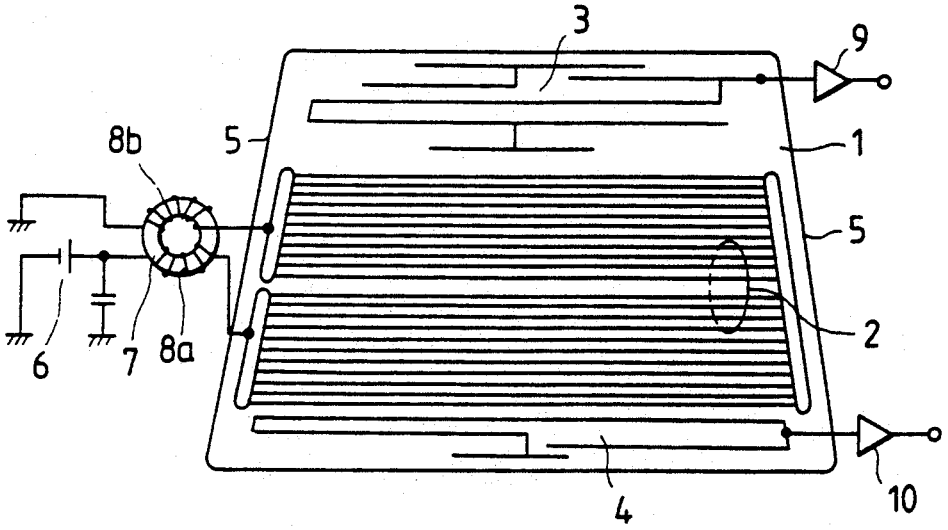
FIG. 1 PRIOR ART
FIG. 1 is a view showing a conventional antenna.

As described above, the symmetrical arrangement of the left and right FM antenna elements 21*a* and 21*b* enables these antenna elements to have the same gain. Further since the spacing between the left and right antenna elements 21*a* and 21*b* is greater than that between the upper and lower antenna elements 3 and 4 of the prior antenna (FIG. 1), good space diversity reception characteristics can be obtained.

Further, because the AM waves are received by the wide receiving area defined by the defogger heating wires 20, this arrangement can achieve much higher gain as compared with the conventional AM antenna composed of a single wire.

Still, further, because of the position of mounting of the FM antenna elements 21*a* and 21*b* on the rear window glass 1, the mounting position of the amplifiers 22*a* and 22*b* connected respectively to these antenna elements is not restricted, and therefore no limitation is imposed on the shape and size of these amplifiers.

Various changes within the spirit of the invention will be apparent to those of working skill in this field. Accordingly, the scope of the invention is to be considered as limited only by the scope of the appended claims.

What is claimed is:

1. A windshield antenna for a vehicle having a window with first and second sides having equal lengths and third and fourth sides having unequal lengths, said antenna comprising:

(a) a first antenna element adapted to receive amplitude-modulated (AM) waves, said first antenna element comprising a plurality of AM wave-receiving antenna elements mounted on a central portion of the window in a multi-line fashion, parallel to said first and second sides of said window, each of said plurality of AM wave-receiving antenna elements having an equal length;

(b) a pair of spaced-apart second and third antenna elements each adapted to receive frequency-modulated (FM) waves, said second and third antenna elements being disposed on first and second sides of said first antenna element, wherein said second and third antenna elements have equal length and width dimensions, and are disposed symmetrically with respect to said first antenna element so that said second and third antenna elements have the same gain; and wherein said first antenna element is superposed on heating wires mounted on the window glass.

2. A windshield antenna according to claim 1, wherein said first antenna element comprises heating wires.

3. A windshield antenna according to claim 2, wherein said heating wires are mounted on the window glass in parallel, closely spaced relation to one another.

4. A windshield antenna according to claim 3, wherein said heating wires extend upwardly and downwardly with respect to the window.

5. A windshield antenna according to claim 1, wherein said window comprises a laminated glass which includes first and second glass panes, and wherein said first antenna is mounted on a surface of said first glass pane, and said heating wires are mounted on a surface of said second glass pane.

6. A windshield antenna according to claim 1, wherein said second and third antenna elements extend upwardly and downwardly with respect to the window.

7. A windshield antenna according to claim 6, wherein said second and third antenna elements are linear elements.

8. A windshield antenna according to claim 6, further comprising first and second amplifiers connected respectively to said second and third antenna elements for amplifying received FM signals, said first and second amplifiers being disposed beneath said window in said vehicle.

9. A windshield antenna according to claim 8, further comprising a third amplifier, connected to said AM antenna element, for amplifying received AM signals.

10. A windshield antenna for a vehicle having a window with first and second sides having equal lengths and third and fourth sides having unequal lengths, said antenna comprising:

a first antenna element adapted to receive amplitude-modulated (AM) waves, said first antenna element comprising a plurality of AM wave-receiving antenna elements mounted on a central portion of the window in a multi-line fashion, parallel to said first and second sides of said window, each of said plurality of AM wave-receiving antenna elements having an equal length;

a pair of spaced-apart second and third antenna elements each adapted to receive frequency-modulated (FM) waves, said second and third antenna elements being disposed on first and second sides of said first antenna element, wherein said second and third antenna elements are arranged symmetrically and have equal length and width dimensions, so as to have the same gain; and wherein said first antenna element is superposed on heating wires mounted on the window glass.

* * * * *